US006370342B1

(12) United States Patent
Masumura

(10) Patent No.: US 6,370,342 B1
(45) Date of Patent: Apr. 9, 2002

(54) TONER CONCENTRATION SENSOR

(75) Inventor: Tomohiro Masumura, Niigata (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/690,082

(22) Filed: Oct. 16, 2000

(30) Foreign Application Priority Data

Oct. 18, 1999 (JP) ..... 11-295615

(51) Int. Cl.[7] ..... G03G 15/10
(52) U.S. Cl. ..... 399/64; 118/691; 356/442
(58) Field of Search ..... 118/691, 689; 399/62, 64, 65; 430/117, 118, 119; 356/434, 436, 441, 442

(56) References Cited

U.S. PATENT DOCUMENTS

| | | | | | |
|---|---|---|---|---|---|
| 4,111,151 | A | * | 9/1978 | Ruckdeschel | 222/DIG. 1 |
| 4,166,702 | A | * | 9/1979 | Okamoto et al. | 118/691 |
| 4,266,141 | A | * | 5/1981 | Hirakura et al. | 118/691 |
| 4,550,998 | A | * | 11/1985 | Nishikawa | 118/691 |
| 4,648,702 | A | * | 3/1987 | Masahiro | 118/691 |
| 5,570,193 | A | * | 10/1996 | Landa et al. | 356/436 |
| 5,860,041 | A | * | 1/1999 | Tanaka et al. | 118/691 |
| 5,960,231 | A | * | 9/1999 | Martinez | 356/442 |

FOREIGN PATENT DOCUMENTS

| | | |
|---|---|---|
| JP | 51-11454 | 1/1976 |
| JP | 63-40351 | 3/1988 |

OTHER PUBLICATIONS

Journal of Japan Adhesive Association, vol. 8, pp. 131–141 (1972).

* cited by examiner

*Primary Examiner*—Robert Beatty
(74) *Attorney, Agent, or Firm*—Ostrolenk, Faber, Gerb & Soffen, LLP

(57) ABSTRACT

A toner concentration sensor has a pair of optical members for optically coupling a light emitting device and a photodetector. The optical members are disposed with a gap therebetween for introducing liquid developer to measure transparency of the liquid developer and to evaluate the toner concentration. The optical member is coated with a chemical adsorption film as an anti-fouling film including at least one of organosilane compounds expressed by the following formulas:

(1)

(2)

and (3)

wherein each of R1, R2 and R3 represents an organic functional group, and each of X1, X2 and X3 is a desorption group.

4 Claims, 2 Drawing Sheets

TONER CONCENTRATION SENSOR

BACKGROUND OF THE INVENTION (a) Field of the Invention

The present invention relates to a toner concentration sensor and, more particularly, to a toner concentration sensor for use in a PPC copying machine or an electrostatic printer using a wet-development electrostatic photographic technique.

(b) Description of Related Art

In general, wet-development-type electrostatic photographic system such as PPC copying machine and electrostatic printer uses a liquid developer wherein a toner including pigments and resins as main components thereof is dispersed in a carrier solvent including aliphatic hydrocarbons obtained from petroleum. Examples of the aliphatic hydrocarbon solvent used therein include Isoper-E, -G, -H, -L, -K and -M and Noper 12 from Exxon Co., and Shellzol 71 and Solvesso 150 from Shell Oil Group. Examples of the pigments used therein include carbon black, azo pigments and multi-cyclic pigments.

In an electrostatic photographic machine (ESPM) using such a liquid developer it is known that the toner concentration in the liquid developer reduces with the proceeding of the recording operation, thereby degrading the image density. Thus, it is important in the ESPM to maintain the toner concentration at a constant in the liquid developer by replenishing the toner therein while detecting the toner concentration. The toner concentration in the liquid developer is detected by a variety of toner concentration sensors each optically detecting the toner concentration.

FIG. 1 shows the principle of a conventional toner concentration sensor, generally designated by numeral 15. The toner concentration sensor 15 includes a housing 11 disposed in a suitable location of the ESPM for defining a passage of the liquid developer 10, a pair of optical members 12 having a gap therebetween and disposed within the housing 11 for penetrating the same, and a combination of a light emitting device 13 and a photodetector 14 optically coupled together by the optical members 12.

The light emitting device 13 emits light through the optical members 12 when the liquid developer 10 is introduced in the housing 11. The emitted light passes through the liquid developer 10 at the gap between both the optical members 12 to be detected by the photodetector 14. The reduction of the toner concentration allows the light intensity detected by the photodetector 14 to increase. The ESPM replenishes the toner into the liquid developer 10 to thereby maintain the toner concentration in the liquid developer at a constant.

The optical members 12 in the toner concentration sensor 15 should have properties such as higher durability against the liquid developer and higher transparency for the light. The optical member 12 is generally made of glass or plastic materials in view of having the above properties. However, as shown in FIG. 2, the surface of some of the optical members 12 have a large number of hydroxyl groups 16 thereon. Such an optical member 12 has a large surface energy depending on the polarity of the hydroxyl groups and a large surface energy of the hydrogen bonds, and the adsorption of the components in the liquid developer, such as the pigments and charge control agents, onto the hydroxyl group 16 accelerates contamination of the optical member 12.

In addition, since the carrier solvent of the liquid developer including the aliphatic hydrocarbons obtained from petroleum generally has no polarity, a higher interaction acts between the toner and the optical member depending on the polarity and the surface energy of the hydrogen bonds to thereby accelerate the contamination of the optical member. The contamination reduces the transparency of the optical member, whereby the ESPM erroneously controls the liquid developer to have a lower toner concentration. As a result, the image density is reduced.

JP Utility Model Application No. 63-040351 describes a toner concentration sensor having a cleaning mechanism for cleaning the emitting surface and the receiving surface of the optical members. However, the cleaning mechanism raises the cost for the toner concentration sensor and also increases the size thereof.

Patent Publication JP-A-51-11454 describes a toner concentration sensor having an optical member coated with a film for prevention of surface contamination caused by the physical adsorption of the toner. The film includes a mixture of siloxane polymer having branch, cyclic, multi-cylic or mesh structures and a compound having Si-N bonds. The described structure, however, achieves a lower degree for prevention of contamination, or a lower anti-fouling function, because the surface energy is not sufficiently reduced in the toner including pigments having a higher cohesive property and a higher physical adsorption property in the case of the adsorption property mainly affected by a dispersion force.

SUMMARY OF THE INVENTION

Figure 1:
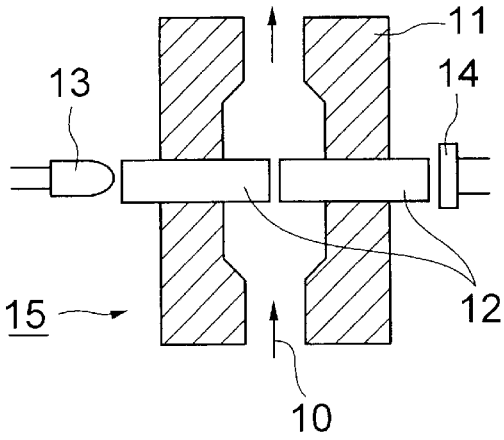
FIG. 1 PRIOR ART
FIG. 1 is a schematic sectional view of a typical toner concentration sensor in an electrostatic photographic system.
Figure 2:
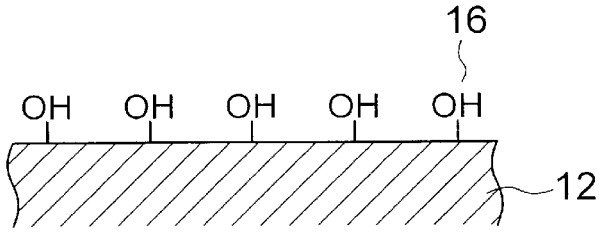
FIG. 2 PRIOR ART
FIG. 2 is a schematic sectional view of the surface of an optical member in a conventional toner concentration sensor such as shown in FIG. 1.

In view of the above, it is an object of the present invention to provide a toner concentration sensor which is capable of accurately detecting the toner concentration of a liquid developer while providing a high anti-fouling function to the optical member, thereby preventing contamination of the optical member by the toner and the contamination of the liquid developer.

The present invention provides a toner concentration sensor including a light emitting device for emitting light, an optical member disposed in a liquid developer for passing the light emitted by the light emitting device through the liquid developer, and a photodetector for detecting the light passed by the optical member to evaluate a toner concentration in the liquid developer, the optical member having a surface including at least one of organosilane compounds expressed by formulas (1), (2) told (3) as follows:

(1)

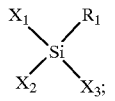

(2)

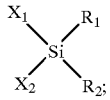

and (3)

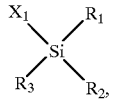

wherein each of R1, R2 and R3 represents an organic functional group, and each of X1, X2 and X3 is a desorption group.

In accordance with the toner concentration sensor of the present invention, the surface of the optical member including at least one of the organosilane compounds expressed by the formulas (1), (2) and (3) acts as a chemical adsorption film having a function for reducing the interaction between the toner including pigments, resins and charge control agents and the body of the optical member to prevent contamination of the optical member and improves the cleaning function of the carrier solvent.

More specifically, the hydroxyl groups on the body of the optical member are reacted with desorbed groups from the at least one of the organosilane compounds to form siloxane bonds (—O—Si—O), and are separated from the optical member. The separation of the hydroxyl group from the body of the optical member suppresses the physical adsorption of the components such as the pigments, resins and charge control agents in the liquid developer onto the surface of the optical member, thereby preventing the contamination of the optical member.

In other words, since the functional groups having a property corresponding to the property of the liquid developer are arranged on the chemical adsorption film, the interaction between the toner and the optical member can be reduced to allow the carrier liquid to improve the cleaning function thereof, thereby further raising the anti-fouling function of the chemical adsorption film.

In addition, since the base of the chemical adsorption film adjacent to the optical member body is formed by covalent bonds with the siloxane bonds, the chemical adsorption film has a long-term durability. Thus, the chemical adsorption film is hardly peeled-off by the liquid developer circulating on the surface of the optical member, thereby having an excellent durability against the circulating liquid developer. This also prevents the liquid developer from being contaminated. The chemical adsorption film in the present invention has a sufficient function even in the case of thickness as small as in the order of nanometers to angstroms, whereby the chemical adsorption film scarcely adversely affects the transparency of the optical member.

PREFERRED EMBODIMENTS OFF THE INVENTION

It is generally required that the optical member in the toner concentration sensor have a higher durability against the liquid developer and a higher transparency for the light. Examples of the substances which meet such requirements include glass, and glass or plastic materials coated with an inorganic film such as ITO (indium-tin-oxide), $SnO_2$ and $TiO_2$. As described before, the surface of the glass or inorganic thin film has a large number of hydroxyl groups and thus higher surface energies based on the polarity and of the hydrogen bonds. In the case of plastic materials such as polypropylene and polyethylene terephthalate, a large number of hydroxyl groups reside on the surface thereof after an oxygen-plasma treatment due to a significant number of hydroxyl groups generated by oxidizing decomposition, although it is considered that the plastic materials inherently include no hydroxyl groups on the surface thereof.

Examples of the pigments used in the liquid developer include: azo pigments such as mono-azo derivatives, dis-azo derivatives, diallylide derivatives, anthraquinone derivatives, benzimidazole derivatives, naphthol-AS derivatives, and β-naphthol derivatives multi-cyclic pigments such as phthalocyanine derivatives, quinacrydone derivatives, perylene derivatives, dioxazine derivatives, quinophthalone derivatives, triaryl carbonium derivatives; and inorganic pigments such as carbon black.

In particular, the pigments such as benzimidazole derivatives, triaryl carbonium derivatives and β-naphthol derivatives, which have large energies based on the polarity and of the hydrogen bonds, are liable to adsorption onto the optical member having hydroxyl groups. Examples of such pigments include P.Y.120, P.Y.151, P.R.1 and P.R.81. The phthalocyanine-based pigments having a higher anisotropy are also liable to adsorption, due to a dispersion force in addition to the polarity. Examples of such pigments include P.B.15, P.B.15;1, P.B.15:2, P.B.15:3, P.B.15:4. P.B.16 and P.B.75.

The other components in the liquid developer include a metal soap used as a charge control agent, such as metal stearates and metal palmitates, and the resins having chelating ligand on the surface thereof and combined with metallic ions. These components are also liable to adsorption onto the surface of the optical member having hydroxyl groups.

Figure 3:
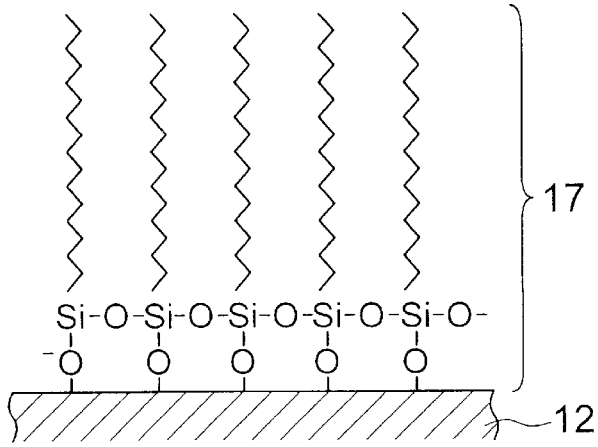
FIG. 3 is a schematic sectional view of the surface of an optical member in a toner concentration sensor according to an embodiment of the present invention.

FIG. 3 shows a chemical adsorption film including an organosilane compound and formed on the surface of an optical member in a toner concentration sensor according to an embodiment of the present invention.

The organosilane in the chemical adsorption film of the optical member 12 is expressed by a formula (1), (2) or (3) having a structure wherein a silicon atom is coupled with desorption groups in number "a" (a=1, 2, or 3) and organic functional groups in number which is equal to 4-a. The organosilane is coupled with the hydroxyl groups on the optical member 12 in a covalent bond through the siloxane bonds which are formed by reaction of the organosilane with the hydroxyl groups on the surface of the optical members.

The chemical adsorption film has organic functional groups having an anti-fouling function corresponding to the characteristics of a specific liquid developer used in the photographic device. More specifically, the organic functional three-dimensional density of the surface of the optical member 12, thereby effectively preventing the contamination of the optical member.

Preferred examples of the desorption groups X1 to X3 in the chemical formulas (1), (2) and (3) include halogen such as chlorine, and alkoxy groups such as methoxy groups and ethoxy groups. In view of the chemical stability, safety and feasibility of treatment, alkoxy groups are most preferred in a mass production. The alkoxy groups can be directly applied onto the surface of the optical member for a surface treatment, followed by thermally drying thereof, other than a surface treatment by using a dipping technique. The structure of the organosilane compounds may be such that the organosilane compounds expressed by formula (1) among formulas (1), (2) and (3) are coupled together by siloxane bonds of the molecules disposed adjacent to each other. This structure improves the mechanical strength of the chemical adsorption film.

Examples of the organosilane considered to be suited to the liquid developer including a toner having a higher polarity and a lower dispersion force include a compound having at least one organic functional group having a lower polarity, such as methyl group, ethyl group, phenyl group and butyl group. The most preferred organic functional group is a long-chain alkyl group, such as dodecyl group, hexadecyle group, and octadecyl group. These long-chain alkyl groups have a larger weakening function for weakening the interaction between the surface of the optical member and the toner by lowering the polarity of the surface, improves the cleaning function due to a higher affinity with the carrier solvent including aliphatic hydrocarbons obtained from petroleum, and acts for prevention of contamination due to the higher three-dimensional density as described above. In addition, these groups are less liable to electrification by friction.

On the other hand, the organosilane compound having fluorinated alkyl groups, such as $CH_2CH_2(C_nF_{2n+1})$,—$(CH_2)_mO(C_nF_{2n+1})$,—$(CH_2)_mSi(CH_3)_2(C_nF_{2n+1})$ wherein "n" and "m" are integers, are also effective for preventing contamination by the toner, and especially suited for a liquid developer having phthalocyanine-based pigment which has a higher dispersion force and thus a higher cohesive force or a liquid developer including a toner having a higher cohesive force. Among other such organosilane compound, an organosilane having a functional group expressed by —$CH_2CH_2(C_nF_{2n+1})$ wherein "n" is an integer between 3 and 25 are most preferable because it reduces the surface energy of the optical member to achieve a superior anti-fouling function due to suitable matching of the dissolubility into the solvent and chemical adsorptive-ability with functions such as the anti-fouling function.

The processes for attaching the chemical adsorption film including the orgonosilane compound onto the optical member may use rubbing, dipping, sol-gel and chemical evaporation (chemical vapor surface-modification) techniques; however, not limited thereto. The chemical adsorption film has a preferable thickness between 0.5 and 50 nm depending on the optical transparency and the anti-fouling function; however, not limited to the recited thickness.

The organosilane compound film in the toner concentration sensor according to an embodiment can be formed by the steps of diluting the organosilane compound by using a volatile solvent at a ratio of 0.5 to 3 wt %, and applying and drying the diluted organosilane compound. The Solvent is not limited to a particular solvent and should be determined based on the stability of the composition, wettability to the substance to be treated and the rate of evaporation.

Upon the surface treatment by using the organosilane compound, the surface of the optical member to be treated should be cleaned beforehand, by removing contamination using a surfactant, removing fat using an organic solvent, and cleaning by using acid, alkali or a hydrogen peroxide aqueous solution.

Embodiment #1

A borosilicate glass rod having a diameter of 6 mm and a length of 10 mm was dipped in an alkali cleaning solution for five hours, followed by rinsing the same by consecutively using tap water and pure water, and treating the same by an ultrasonic wave in an ethanol solution for five minutes. The resultant glass rod was then dried enough and dipped in an anhydrous toluene solution, into which octadecyl trichlorosilane (ODS) is dissolved at a concentration of 1 wt %, for 30 minutes in a dried ambient. The glass rod was then cleaned by using toluene and thermally dried at a temperature of 100° C. for an hour.

The optical member of embodiment #1 thus manufactured was subjected to measurements of the contact angle thereof using water, ethyleneglycol, tetrabromoethane, α-bromonaphthalene, hexane and dodecane, and measurements of surface energy by using an extended Fowkes equation (See "Journal of Japan Adhesive Association", Vol. 8, pp131–141 (1972)). The results of the measurements are shown in Table 1, wherein $\gamma_E{}^a$ is the surface energy by the dispersion force, $\gamma_s{}^b$ is the surface energy based on the polarity, $\gamma_s{}^c$ is the surface energy of the hydrogen bonds, and $\gamma_s$ is the total of these energies which represents the surface energy of the optical member.

Embodiment #2

The optical member of embodiment #2 was manufactured similarly to the embodiment #1 except that the surface treatment was conducted in embodiment #2 by a m-xylenehexafluoride solution, wherein hepthadecafluorodecyl-trimethoxysilane (HFS) was dissolved at a concentration of 3 wt % instead of octadecyltrichlorosilane (ODS). The resultant optical member was subjected to measurements similarly to embodiment #1.

Comparative Example

Optical member of a comparative example was manufactured similarly to the embodiment #1 except for the omission of the surface treatment using an organosilane compound in the comparative example. The comparative example was subjected to measurements similarly to embodiments #1 and #2.

TABLE 1

| Optical Member | Surface Layer | Surface Energy (dyne/cm) $\gamma_\epsilon{}^a$ | $\gamma_\epsilon{}^b$ | $\gamma_s{}^c$ | $\gamma_s$ |
|---|---|---|---|---|---|
| Emb. #1 | ODS | 38.7 | 0.4 | 0.8 | 38.9 |
| Emb. #2 | HFS | 14.8 | 0.3 | 0.1 | 15.2 |
| Com. Ex. | Nonc | 41.0 | 1.5 | 7.6 | 50.1 |

As understood from Table 1 the glass surface of the comparative example had larger energies by the dispersion force and of the hydrogen bonds as well as the surface energy based on the polarity, and thus had a larger total surface energy.

The embodiment #1 surface-treated by using ODS had surface energies based on the polarity and of the hydrogen bonds which were significantly lower than those of the comparative example, and yet a surface energy by the dispersion force which is similar to that of the comparative example.

The embodiment #2 surface-treated by using HFS had all the surface energies significantly lower than the surface energies of the comparative example, and also lower than those of polytetrafluoroethylene.

Embodiment #3

A pair of glass rods manufactured according to embodiment #1 were used as optical members as shown in FIG. 1. The optical members 12 were arranged in a flow of liquid developer 10 so that the light emitted from the light emitting device 13 was transmitted to the photodetector 14 through the developer 10, the optical members 12, sold the gap therebetween which was 1.0 mm long.

Figure 4:
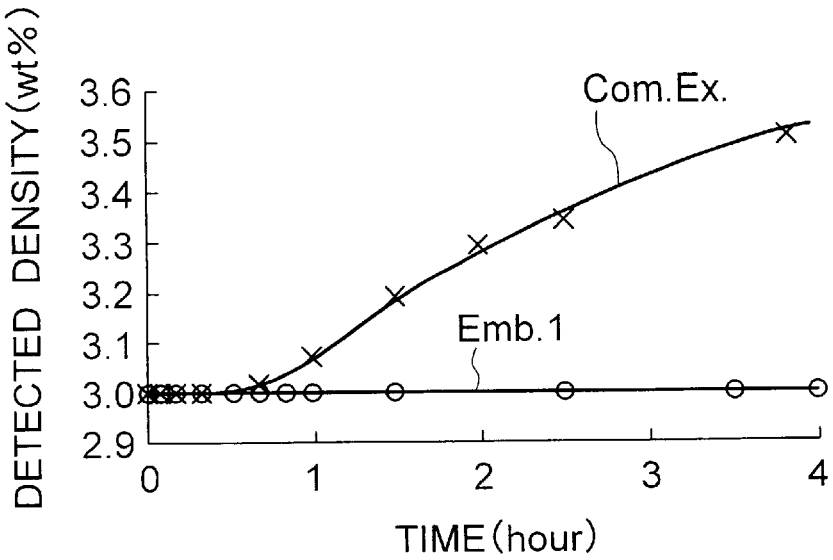
FIG. 4 is a graph for showing the relationship between detected toner density and operating time of the toner density sensor according to a first example of the present invention.

The developer, which included Noper 12 supplied from Exxon as a carrier solvent and a solid triarylcalbonium-based substance, P.R.81, contained in the carrier solvent as a pigment at a concentration of 3.0 wt %, was circulated at a flow rate of 400 ml/minute. The current flowing through the photodetector 14 was measured and converted into the term of solid component density value for the purpose of evluation of the contamination of the surface of the optical members. FIG. 4 shows the results of the evaluation.

The surface of the optical members manufactured from the glass rod of the comparative example was also subjected to evaluation similarly to the embodiment #3. The results of the evaluation are also shown in FIG. 4 for comparison.

The toner concentration sensor having the glass rod of the comparative example exhibited a rise in the measurements of the toner concentration after four hours of operation by 0.5 wt % in terms of the toner concentration due to the contamination of the glass rods, resulting in a significant error in the detection. On the other hand, the toner concentration sensor having the glass rod of embodiment #1 did not substantially exhibit a change in the detected value for the toner concentration after 100 hours of a similar operation in similar conditions.

Embodiment #4

Figure 5:
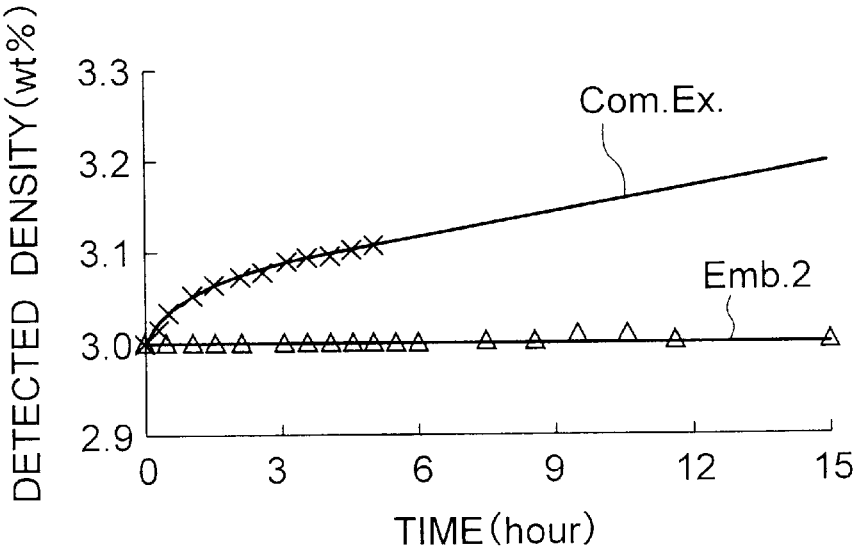
FIG. 5 is a graph for showing the relationship between detected toner density and operating time of the toner density sensor according to a second example of the present invention.

The glass rods of example #2 and the comparative example were also evaluated while a liquid toner which included a phthalocyanine-based pigment, P.B.15:4, was circulated similarly to embodiment #3. The results of the evaluations are shown in FIG. 5. The toner concentration sensor having the glass rods of the comparative example exhibited a rise of 0.2 wt % in terms of the toner concentration after 15 hours of similar operation, whereas the toner concentration sensor having the glass rod of embodiment #2 exhibited a substantially constant toner concentration after 200 hours of a similar operation in similar conditions.

After the evaluations of the comparative example and embodiments by the detected toner concentration, the glass rods were dipped in Noper 12 and observed with a microscope, which showed a significant contamination of the glass rod of the comparative example and a substantially no contamination of the glass rods of embodiments #1 and #2.

Since the above embodiments arc described only for examples, the present invention is not limited to the above embodiments and various modifications or alterations can be easily made therefrom by those skilled in the art without departing from the scope of the present invention.

What is claimed is:

1. A toner concentration sensor comprising a light emitting device for emitting light, an optical member disposed in a liquid developer for passing the light emitted by said light emitting device through the liquid developer, and a photodetector for detecting the light passed by the optical member to evaluate a toner concentration in the liquid developer, said optical member having a surface including at least one of organosilane compounds expressed by formulas (1), (2) and (3) as follows:

(1)

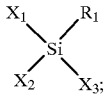

(2)

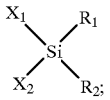

and (3)

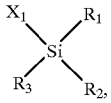

wherein each of R1, R2 and R3 represents an organic functional group, and each of X1, X2 and X3 is a desorption group.

2. The toner concentration sensor as defined in claim 1, wherein at least one of R1 to R3 is an alkyl group.

3. The toner concentration sensor as defined in claim 1, wherein at least one of R1 to R3 is an organic functional group including fluorine.

4. The toner concentration sensor as defined in claim 1, wherein at least one of X1 to X3 is an alkoxy group.

* * * * *